US009416590B2

(12) United States Patent
Voegele, Jr. et al.

(10) Patent No.: US 9,416,590 B2
(45) Date of Patent: Aug. 16, 2016

(54) BUILDING ENVELOPE SOLAR HEAT AND DAYLIGHTING CONTROL SYSTEM

(71) Applicant: Extech/Exterior Technologies, Inc., Pittsburgh, PA (US)

(72) Inventors: William P. Voegele, Jr., Pittsburgh, PA (US); John Anthony, Allison Park, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 0 days.

(21) Appl. No.: 14/932,288

(22) Filed: Nov. 4, 2015

(65) Prior Publication Data

US 2016/0123000 A1 May 5, 2016

Related U.S. Application Data

(60) Provisional application No. 62/074,676, filed on Nov. 4, 2014.

(51) Int. Cl.

| | |
|---|---|
| ***E06B 7/084*** | (2006.01) |
| ***E06B 9/78*** | (2006.01) |
| ***E04F 19/00*** | (2006.01) |
| ***E06B 9/24*** | (2006.01) |
| ***E06B 9/266*** | (2006.01) |
| ***E06B 9/34*** | (2006.01) |
| ***E06B 9/386*** | (2006.01) |
| ***E06B 9/50*** | (2006.01) |
| ***E06B 9/68*** | (2006.01) |
| *F21V 33/00* | (2006.01) |

(52) U.S. Cl.

CPC . *E06B 9/78* (2013.01); *E04F 19/00* (2013.01); *E06B 9/24* (2013.01); *E06B 9/266* (2013.01); *E06B 9/34* (2013.01); *E06B 9/386* (2013.01); *E06B 9/50* (2013.01); *E06B 9/68* (2013.01); *F21V 33/006* (2013.01)

(58) Field of Classification Search

CPC ..... E06B 7/08; E06B 7/084; E06B 7/086; E06B 9/26; E06B 9/04; E06B 9/40; E06B 9/42; E06B 2009/2643; E04B 1/74; E05F 11/36; E05F 5/02

See application file for complete search history.

(56) References Cited

U.S. PATENT DOCUMENTS

| | | | | | |
|---|---|---|---|---|---|
| 7,203 | A * | 3/1850 | Williams | E06B 7/084 | 49/74.1 |
| 124,050 | A * | 2/1872 | Gathmann | E05F 11/36 | 49/337 |
| 439,912 | A * | 11/1890 | Ward | E06B 7/084 | 49/335 |
| 1,487,331 | A * | 3/1924 | Husser | E05F 11/36 | 49/341 |

(Continued)

*Primary Examiner* — Katherine Mitchell
*Assistant Examiner* — Abe Massad
(74) *Attorney, Agent, or Firm* — McKay & Associates, PC

(57) ABSTRACT

A building envelope or cladding system which permits selective visibility from inside the building while rejecting solar heat and providing an optional insulative envelope. A vertical support mullion is on one side of a building structure. A module is attached to the mullion using a hinge, wherein the module is adapted to flip away from the mullion. A drive means includes a gear system housed within the module and a drive shaft connected through the building structure. One or more cladding elements is connected to and operable by the drive means. As a result, the cladding elements can both rotate and flip away to expose or cover an underlying glass surface. Each module is coupled to the drive means using a coupling assembly which is spring-biased to thereby rotate the cladding elements, thus modifying the effects of the sun and other ambient factors on the state of the building.

16 Claims, 9 Drawing Sheets

(56) References Cited

U.S. PATENT DOCUMENTS

| | | | | | |
|---|---|---|---|---|---|
| 2,526,467 | A * | 10/1950 | Fry | E05F 5/02 | 16/86 A |
| 3,012,294 | A * | 12/1961 | Waldor | E06B 9/36 | 126/629 |
| 4,049,038 | A * | 9/1977 | Hyman | E06B 9/386 | 160/166.1 |
| 5,580,307 | A * | 12/1996 | Arosio | A62C 2/14 | 137/601.09 |
| 6,499,264 | B2 * | 12/2002 | Swapp | E06B 7/08 | 160/236 |
| 6,598,650 | B1 * | 7/2003 | Palmer | B29C 53/52 | 160/236 |
| 7,888,587 | B2 | 2/2011 | Shingleton et al. | | |
| 8,256,167 | B2 | 9/2012 | Braybrook | | |
| 8,342,224 | B2 | 1/2013 | Rountree | | |
| 8,381,449 | B1 | 2/2013 | Hodgetts et al. | | |
| 8,528,621 | B2 | 9/2013 | Murphy, Jr. et al. | | |
| 8,723,092 | B2 | 5/2014 | Bartenbach | | |
| 8,824,051 | B2 | 9/2014 | Thuot et al. | | |
| 8,825,500 | B2 | 9/2014 | DeBartolo, III et al. | | |
| 8,851,144 | B2 | 10/2014 | Forbis et al. | | |
| 2007/0266636 | A1 * | 11/2007 | Chen | E06B 7/096 | 49/82.1 |
| 2008/0000175 | A1 * | 1/2008 | Spoltore | E04H 17/16 | 52/202 |
| 2008/0245015 | A1 * | 10/2008 | Sweeney | E06B 7/08 | 52/473 |
| 2011/0000152 | A1 | 1/2011 | Botke | | |
| 2011/0214712 | A1 | 9/2011 | Frazier | | |
| 2012/0048262 | A1 * | 3/2012 | Chang | E06B 7/084 | 126/702 |
| 2012/0180957 | A1 | 7/2012 | Svirsky | | |
| 2012/0231222 | A1 | 9/2012 | Botke | | |
| 2013/0099185 | A1 | 4/2013 | Rountree | | |
| 2013/0111814 | A1 * | 5/2013 | Drohan | E06B 3/6722 | 49/82.1 |

* cited by examiner

Option #1 FIG. 5 Option #2

Option #3 FIG. 6 Option #4

BUILDING ENVELOPE SOLAR HEAT AND DAYLIGHTING CONTROL SYSTEM

CROSS-REFERENCE TO RELATED APPLICATIONS

Benefit is hereby claimed to U.S. provisional application Ser. No. 62/074,676, filed Nov. 4, 2014, the contents of which are incorporated herein by reference.

BACKGROUND

1. Field of the Invention

The instant invention relates to systems of variable light-transmitting coverings for building exteriors which will permit selective visibility from inside the building while rejecting solar heat and while minimizing the amount of heat that is radiated into the building by the solar heat rejecting apparatus. Additionally, the instant system will provide a blanket covering the building, thus, providing a thermal blanket as well as a shell for security purposes.

2. Description of the Related Art

Louvered panel systems for cladding an outside wall are known in the art. For example, WO2013036112 relates to an outside wall cladding element. The outside wall cladding element comprises a structure of a panel-shaped material and fastening elements to be mounted on the outside wall, in which the panel-shaped material comprises a zigzag or wave-shaped element, and is provided with a side comprising a light-absorbing layer and another side comprises a light-reflecting layer.

U.S. Patent No. 20110214712 teaches a solar window shade which includes a frame for supporting louvers for shading at least one window of a building. Preferably, the frame is pivotally connected to the building above the window, and a frame drive system selectively pivots the frame upwardly or downwardly in accordance with the elevation of the sun. A louver drive system rotates the louvers within the frame to track east-to-west movements of the sun. The louvers are preferably provided as outer and inner louvers interlaced with each other, and such louvers nest with one another when the sun is hidden, or approaches from an acute angle, to maximize passage of indirect light rays to light the interior, while minimizing obstruction of the view through the window. The device is modular and is easily applied to aligned rows of windows and/or windows on multi-story buildings, with central control of the associated frame drive and louver drive systems.

U.S. Pat. No. 8,342,224 shows an architectural louver shade assembly comprising a shade canopy mounted to a rotatable central axle tube that supports a rod rib assembly to which the shade canopy is attached by adjustable tensioners that mechanically stretch and tension the fabric element of the shade canopy to remove wrinkles and sags. A wax cylinder piston attached by elements of a wax piston pressure system that changes the pitch of the shade canopy in response to temperature with a gas spring unit that returns the shade canopy to its default, horizontal orientation with decreasing temperatures. An optional manual/mechanical system that, through use of control cables, changes the pitch of the shade canopy with a gas spring unit that returns it to a default orientation. A camber cable assembly that maintains an equal compression load on the rib arm units that directly support the shade canopy, and carrier brackets that support the central axle tube and connect the louver shade assembly to a building wall.

U.S. Patent Publication No. 20110214712 describes methods, apparatus, and systems relating to the use and design of specially shaped, rotating reflective louvers to provide cost effective harvesting of electricity, heat, and/or lighting are described. In an embodiment, the reflected and concentrated direct light is focused on the neighboring louver photovoltaic cells to generate electricity and an integral cooling channel allows heat collection. A skylight embodiment permits the indirect light to pass between the louvers and through a transparent backing providing high quality natural light inside while allowing artificial lights to be dimmed or turned off saving energy. In some embodiments, control systems (that may be computer controlled) can modulate the louver position to improve the light transmitted into the building when appropriate to maximize the net energy saved or generated depending on the situation. Moreover, the devices can be retrofitted into existing buildings or integrated into new building construction.

SUMMARY

In general, what is described herein is a system of building cladding which incorporates specially-designed louvers and/or roll-down shutters, and which accomplishes the goals of providing excellent solar heat rejection and night-time building insulation value and security while presenting a new and desirable building aesthetic.

It is the objective of the instant invention to provide an improvement on existing louver systems by providing a modular unit which can be installed as a unit or in an array, covering a complete wall if desired. These modules can be installed over either existing or new curtainwall or other acceptable building structures.

It is further an objective to provide modules designed to operate either manually or electrically, in both cases being controlled from inside the building.

It is further an objective to provide an assembly of louver blades which can swing away from the underlying glass to expose the glass for cleaning, repair, or replacement. In one embodiment the module is connected to the vertical support mullion by way of a hinge. As a result the module can be swung away from the vertical support mullion, thereby exposing the underlying glass.

Accordingly, described is a building envelope, comprising a vertical support mullion on one side of a building structure; a module attached to the vertical support mullion using a hinge, wherein the module is adapted to swing away from the vertical support mullion; a drive means including a gear system housed within the module and a drive shaft connected through the building structure; one or more cladding elements connected to and operable by the drive means; and, wherein the cladding elements can rotate in a vertical plane, and the complete module can swing away from the vertical support mullion to expose or cover an underlying glass surface. The cladding is coupled to the drive means using a coupling assembly which is biased by a spring and which includes a coupling groove in which a blade shaft within the module can seat to thereby rotate in response to the drive means, thus moving a worm gear assembly which then moves the louver blades (cladding elements) of the system.

The cladding can be a roll-down shutter or louver (cladding elements) system, and each louver can be coated with a heat-reflective coating material. Additionally, each louver blade can rotate around a y-axis while the module in which the louver is fixed can swing in an XY plane away from the vertical support mullion to partially expose or cover the underlying glass surface, as further described.

DETAILED DESCRIPTION OF THE PREFERRED EMBODIMENT

Figure 1:
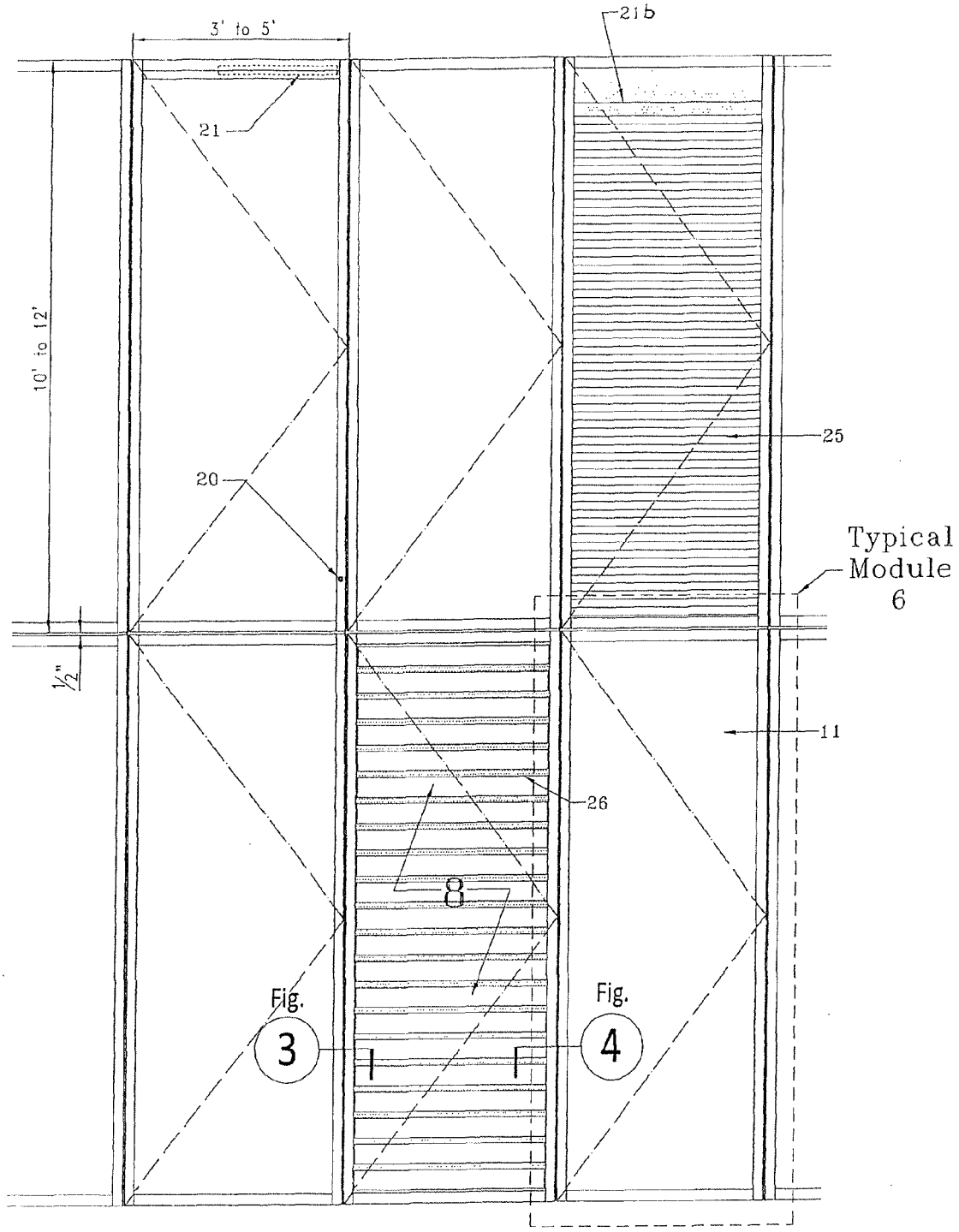
FIG. 1 shows an elevation view of the instant system.

With reference then to FIG. 1, shown are six modules of potentially many of the instant building envelope, including one typical module 6 which is a perimeter frame that captures an array of cladding elements 8, here louver blades 26. These are modular units for installation over either existing or new curtainwall or other acceptable building structures. As an example only, these modules (units) are typically 3'-5' wide, which is the width of common curtainwalls, and 10-ft. to 12-ft. high, similar to floor-to-floor height of most commercial buildings, although other dimensions are likely. Shown in FIG. 1 is an array of cladding elements 8 of modules 6 clad with either an array of multiple louver blades 26, or roller shutters 25 (or shades), thus "building envelope" means one or more of any of the cladding elements 8, arrays or arrangements therefor. Additionally, as it relates to all components, "a" as used in the claims means one or more. Each module 6 would cover an exterior wall/underlying surface. The underlying surface 11 in this example is glass. The frame of the module 6 is typically aluminum. The louver blade array 8 and the roller shutters 25 are typically aluminum or painted steel. Both the louver blade array 8 and the roller shade 25 units can be coated on the outer-facing surfaces with a coating material, typically paints, which reject or reflect solar energy. The coating on the interior-facing surfaces is a material which tends to not reflect heat, thus, saving the building from "feeling" the heat radiated from the louver blades themselves.

Figure 2:
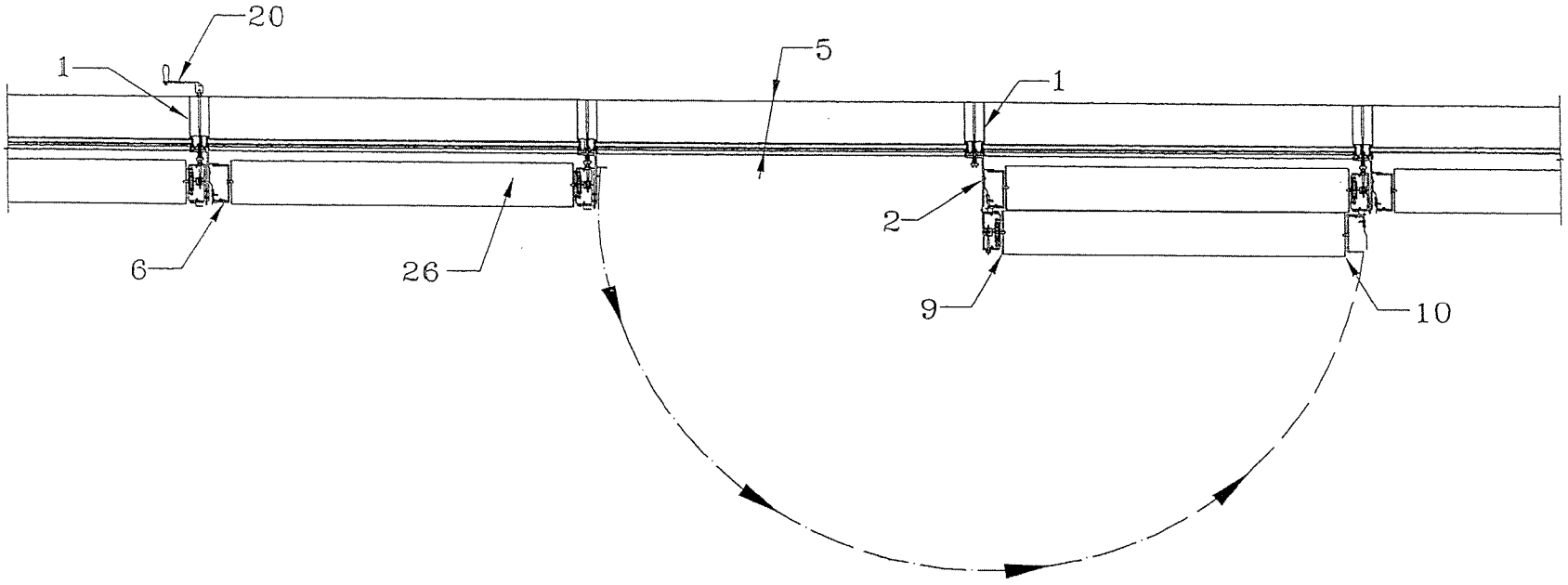
FIG. 2 shows a top plan view of three modules with one of the modules shown rotated, or swung, on its hinges into an open, locked position to allow access to the glass wall.
Figure 3:
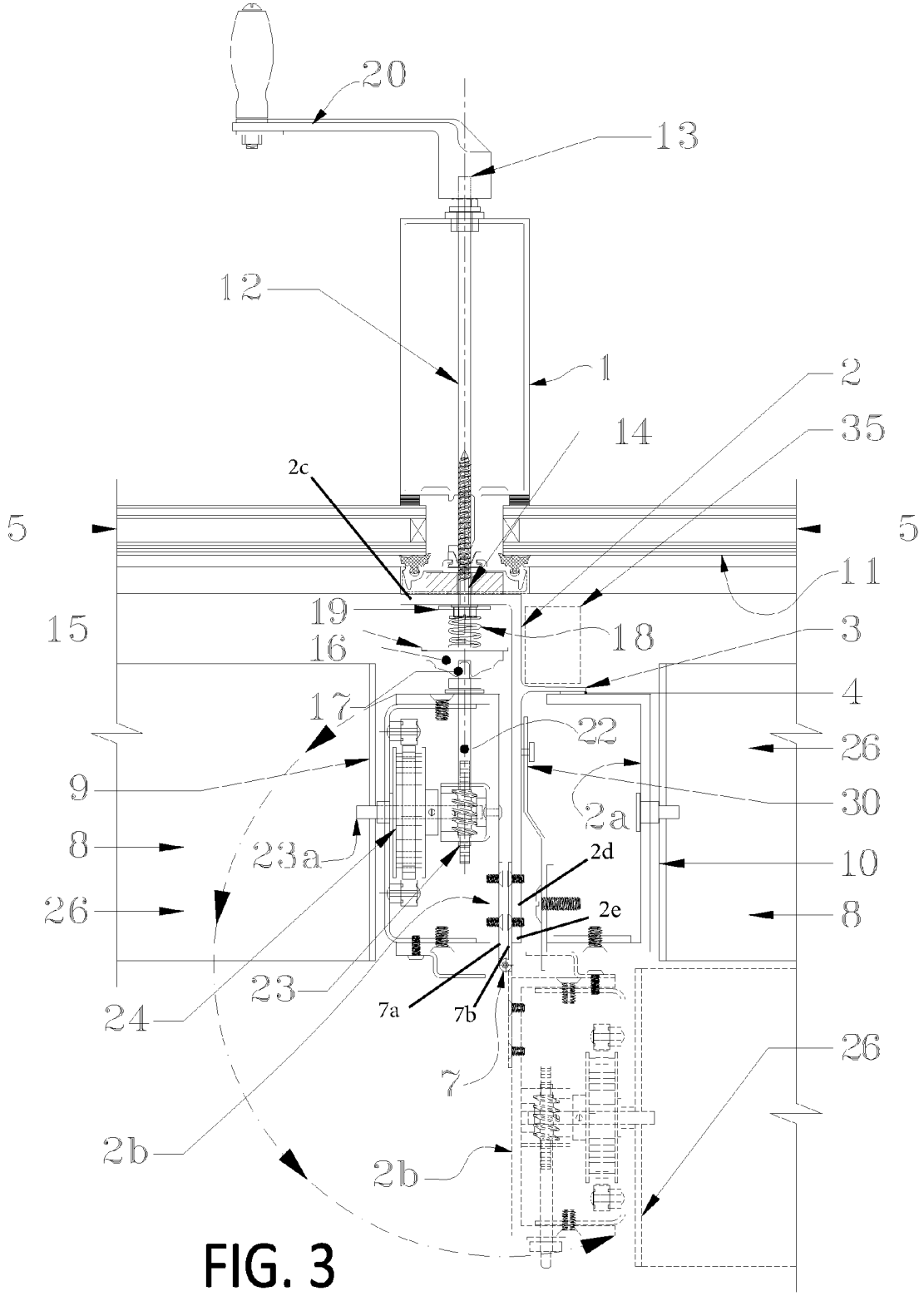
FIG. 3 shows a top plan view of a typical glass curtainwall mullion, the vertical support mullion of the new system, the main frames of the modules, the cladding elements or louvers, the inside and outside drive shafting and the geared mechanisms which rotate the cladding elements.
Figure 4:
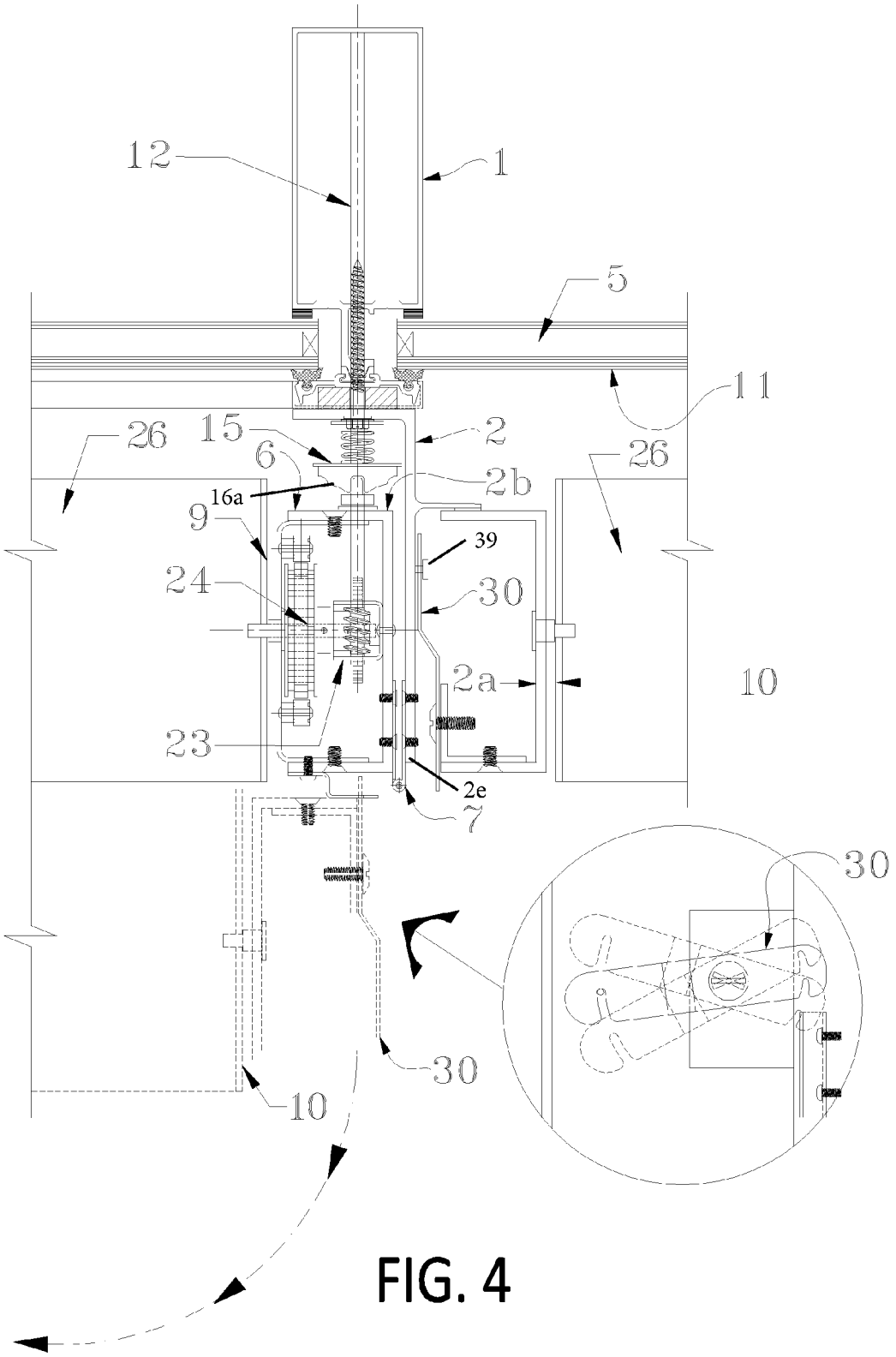
FIG. 4 shows a top plan view of an array of cladding with the vertical support mullion, portions of three modules (one shown in the open [locked] position) and a sub-figure shows a rotating clip means for securing a module in the open (locked) position.
Figure 5:
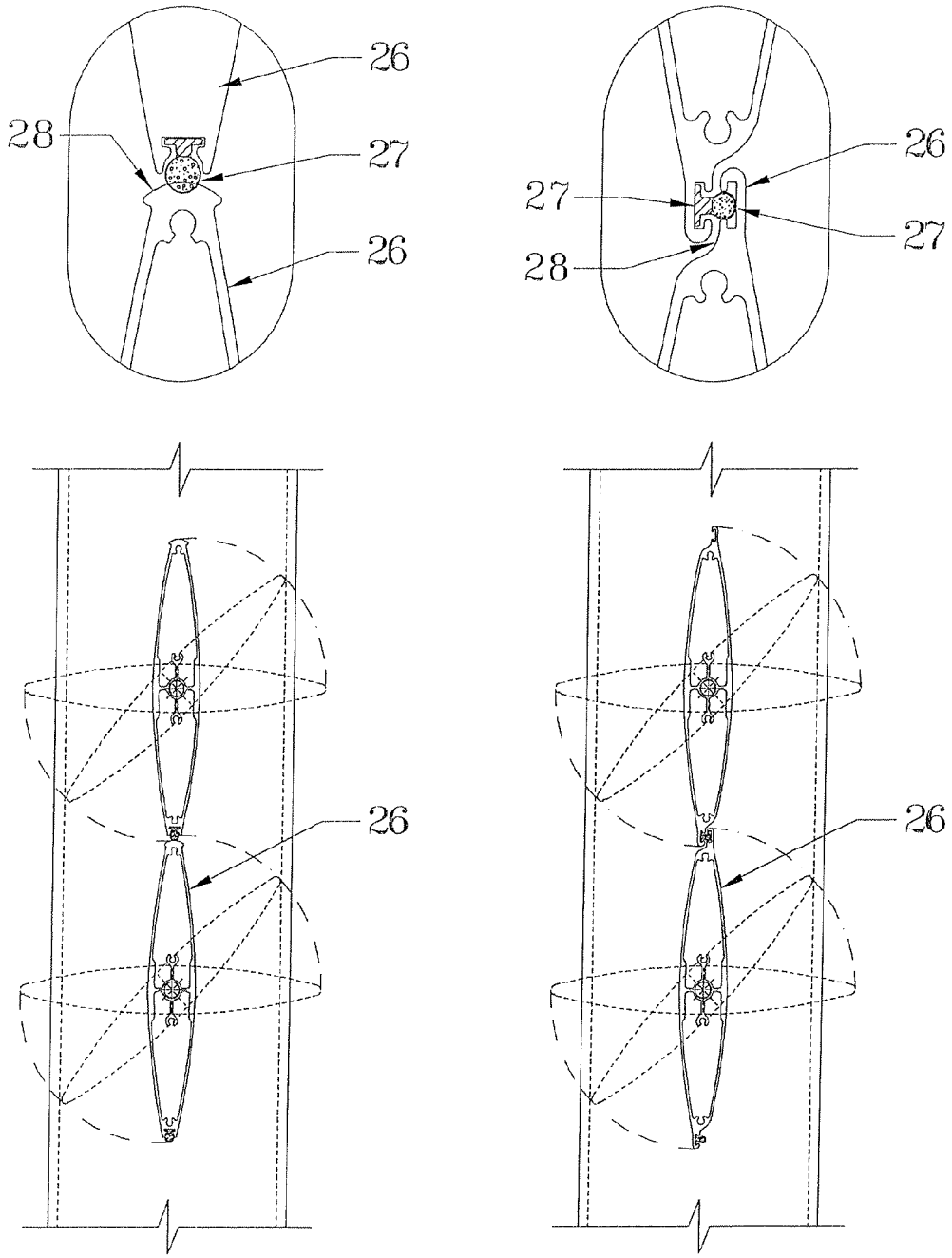
FIG. 5 shows a cross-sectional view of the louver blades including an alternate contact method.

Referencing now FIGS. 2-4, the building envelope is shown in part, being comprised of curtain wall mullions 1 and vertical support mullions 2. The frames 2*a* and 2*b* forming each U-shaped module 6 hold louver blades 26 and are attached to vertical mullion 2 by hinge(s) 7. They may be installed as individual units or in arrays. The curtain wall mullion 1 would be on the interior side of the building structure 5 and would aesthetically house a driving mechanism, as further described. In this example, the building structure 5 is a curtain wall, although any wall or building structure 5 is intended and by this definition also encompasses pre-existing or newly fabricated walls. The vertical support mullion 2 would be on one side, here the opposing, exterior side of the building structure 5 which is used to support most of the components of the building envelope. Since the system can be installed over building structures 5, either new or existing, vertical support mullion 2 is either fabricated or pre-existing. In this embodiment vertical support mullion 2 is generally L-shaped as shown, having a wall end 2*c*, a projecting end 2*d*, and a stop 3. Projecting end 2*d* has a support inner edge 2*e* distal from the wall end 2*c*. Stop 3 is offset from wall end 2*c* and extends linearly and perpendicularly from projecting end 2*d* between the wall end 2*c* and support inner edge 2*e* in an opposite direction as wall end 2*c*. Wall end 2*c* fastens to the curtain wall mullion 1 but then projecting end 2*d* extends perpendicularly from wall end 2*c*, thus extends outward to hold the hinge(s) 7 which then hold the framing module(s) 6. Hinge 7 includes two plates 7*a*, 7*b*, wherein one of the plates is attached to the projecting end 2*d*. Module 6 is attached to the other plate of hinge 7.

The module framing would have a top and bottom framing member and a left and right side framing member, in particular left vertical frame 2*a* and right vertical frame 2*b*. Such side designations are based on observing a complete module 6 from the outside. Positioned at and connected to each right vertical frame 2*b* would be hinge 7. At both left vertical frame 2*a* and right vertical frame 2*b* the modules 6 are structurally similar, but at one of the sides, modules 6 act as a housing for drive components, whereas on the other side, module 6 simply houses the pivots for the left end(s) of the louver blades 26. Shown here, right vertical frame 2*b* is attached to the vertical support mullion 2 using hinge(s) 7. As a result, the module 6 is adapted to swing away from the vertical support mullion 2.

Still with reference at right vertical frame 2*b*, a drive means (for moving the cladding 8) includes a worm gear assembly 23 housed within this frame 2*b* and a drive shaft 12 which connects through building structure 5. The worm gear assembly 23 is operable by drive shaft 12. Drive shaft 12 has an inner shaft end 13 and an outer shaft end 14. A crank 20 for hand-operating the drive means can be attached to inner shaft end 13, or the drive means can be operated electrically by providing any type of drive motor. FIG. 1 shows a typical motor location 21 for a drive motor (typical position shown in FIG. 1). The connection of the motor to the gear assembly is not shown but this method is well known in the industry.

Outer shaft end 14 is engaged to a coupling assembly 15. Thus, coupling assembly 15 is disposed between the module frame 2*b* and the building structure 5 as shown. Coupling assembly 15 includes a coupling 16. Coupling 16 has sloped surface 16*a*. The coupling 16 can slide along outer shaft end 14, constrained by spring 18 which rests against washer 19. A coupling groove 17 is defined diametrically along the entire diameter of the coupling 16 to thereby bisect the coupling 16 and receive gear shaft 22.

A worm and sprocket gear assembly, or gear system 21*a*, is housed on gear shaft 22. Although a variety of gears and arrangements can be employed, shown here is a gear system 21*a* which is driven by gear shaft 22. Gear shaft 22 incorporates a blade end which is shaped to fit within coupling groove 17 of coupling 16. The worm gear assembly 23 via blade shaft 23*a* operates sprocket assembly 24 rotationally. Sprocket assembly 24 drives connected louver blade 26 via blade shaft 23*a* in a rotational fashion. Thus, as motor 21 (See FIG. 1) or crank 20 operates drive shaft 12, louver blade 26 can be rotated completely up to 360 degrees and beyond. Of note is that as a result of the above configuration, the blade shaft 12 is essentially spring-loaded so it will only drive gear shaft 22 upon fitting into coupling groove 17. Movement of shaft 12 in the inner direction is possible if spring 18 is compressed. Such compression will occur if module 6 is swung closed via hinge 7 and when nearly in the closed position the blade end of gear shaft 22 encounters the sloped surface of coupling 16 and forces coupling 16 and drive shaft 12 inward. This will allow the closing of a unit even if the gear shaft 22 and coupling groove 17 do not align. At a later point in time, a person inside the building can simply turn the crank 20 and the gear shaft 22 will snap into the coupling groove 17 when they are aligned.

Now, with continued reference to FIGS. 3 and 4 but now at left vertical frame 2*a*, a stop 3 extends from vertical support mullion 2. Stop 3 positions left vertical frame 2*a* (of module) when left vertical frame 2*a* is rotated on hinge 7 to the closed position. A cushion 4 is adhered to stop 3, to reduce the impact when frame 2*a* is returned to its closed position. A typical module 6, if not locked, is free to rotate on hinge 7 with vertical frame 2*a* separating away from stop 3. Recall that the same module 6 is hingedly attached to vertical support mullion 2. The entire module 6 and thus vertical frame 2*a* can easily be released and rotated about a vertical axis (move away from vertical support mullion 2) through the X-Y plane constrained by hinge 7. As such, the underlying glass surface 11 can be at least partially exposed (partially or entirely) accessed for repair, replacement, or cleaning. More particularly, each louver blade 26 has a right end 9 engaged to the drive means at the right vertical frame 2*b* wherein the louver blade 26 can rotate around a horizontal Y-axis that passes through the blade shaft 23*a* and the sprocket assembly 24 parallel to building structure 5, i.e. the worm gear assembly 23 to drive shaft 22. Each louver blade 26 has a left end 10 opposite its right end 9 which is adapted to swing away from and towards the stop 3. Thus, vertical frame 2*b* rotates on hinge 7, while the other vertical frame 2*a* also rotates but moves a greater distance circumferentially because it is located farther from the hinge point. Therefore, each louver blade 26 can both rotate about a horizontal axis (around the Y-axis of blade shaft 23*a*) and can swing about a vertical axis (180° through X-Y plane).

Locking clip(s) 30 can be employed, for example on the left side of a typical module 6, where security latching is made to the adjoining vertical support mullion 2 via clip 30 to secure that left side such that the unit cannot swing open on its hinges. See FIG. 4 for example. Means for maintaining the cladding in an aligned position includes any type of clip 30 that can latch on to and mate with a neighboring clip, post, or anchor. Here, anchor 39 is attached to projecting end 2*d* of vertical support mullion 2 such that locking clip 30 attached to module 6 at left vertical frame 2*a* engages the anchor 39 of the vertical support mullion 2 to situate the left end 10 of the louver blade 26.

Referencing now FIGS. 5-8, in the case of the cladding/units which are comprised of louver blades 26, in one embodiment the blades 26 are designed with an elastomeric seal 27, i.e. weather-stripping or gasket, on one edge of each louver blade 26. When the louvers are in an aligned position, the elastomeric seal 27 on one louver blade 26 is compressed slightly when touching the adjoining edge 28 of the adjacent louver blade 26. That adjoining edge 28 is rounded so as to allow the elastomeric seal gasket to move into the compressed position easily when the alignment of the louver blades 26 is desired (see option #1 of FIG. 5).

An alternate configuration for the louver blades 26 is one in which each blade 26 overlaps the other slightly. In those cases, a similar elastomeric seal 27 is attached to one end of one louver blade 26 where it makes contact with the adjoining louver blade (see option #2 of FIG. 5).

Figure 6:
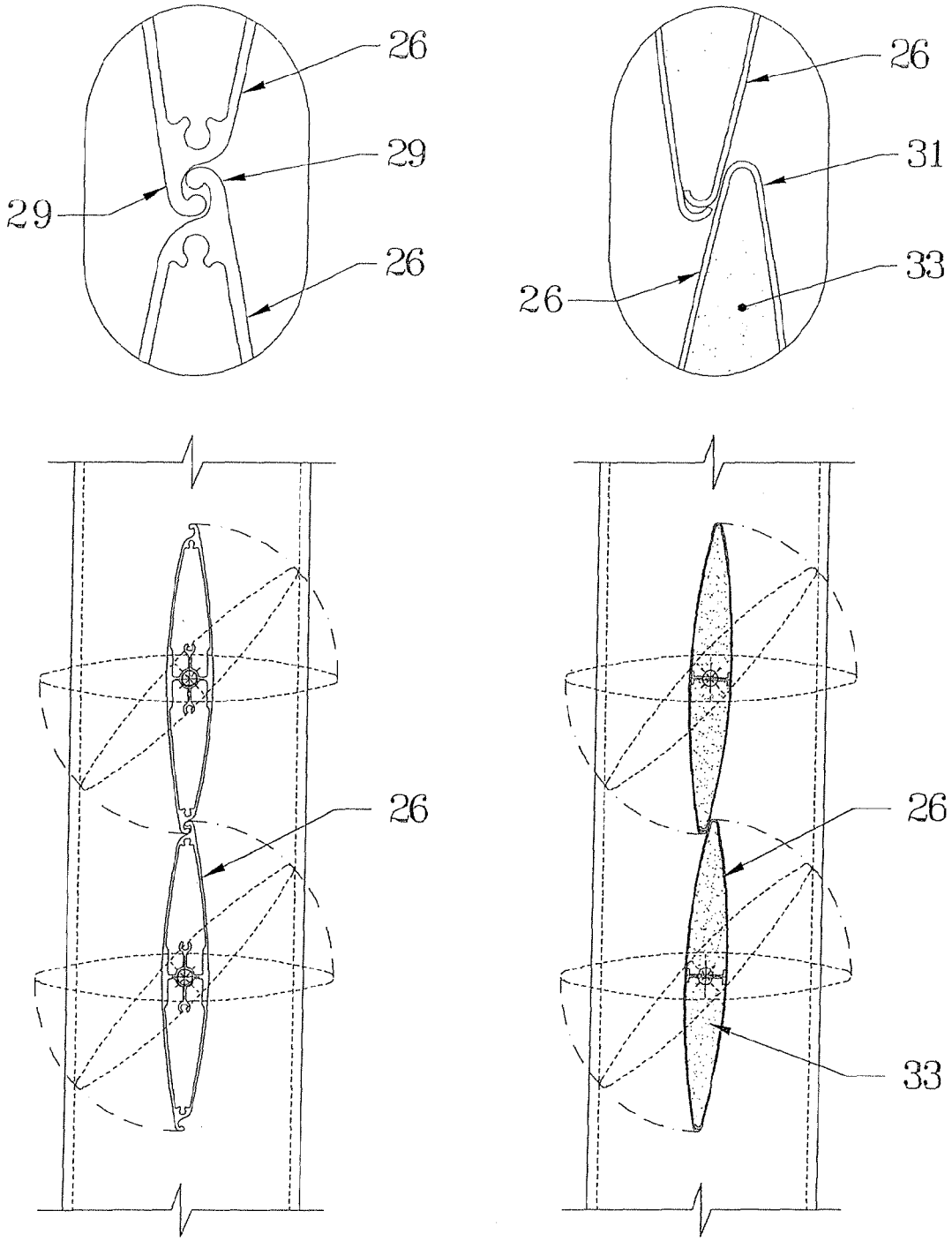
FIG. 6 shows a cross-sectional view of alternative embodiments of the louver blade contact method.

Still another embodiment is one in which the edges of the louver blades 26, where they adjoin, are designed in a "hook" fashion, thereby forming a hook-shaped edge 29 so that the edge of one blade 26 grips the edge of the other blade 26 in the event of an impact to one or both of the blades (see option #3 of FIG. 6).

Still another embodiment is one in which any of the blades 26 has its cavity filled with foam insulation 33 (see option #4 of FIG. 6). This is of particular value when the outer face of the louver blade becomes heated, for example, due to sunlight, and the desire is to not transfer that heat to the other side of the louver blade 26. Foam insulation is also advantageous for purposes of creating a thermal blanket for the building when the louver blades 26 are completely closed with blade edges 31 overlapped, for example, at night and is further advantageous for strengthening the louver blade array of cladding elements 8.

Figure 7:
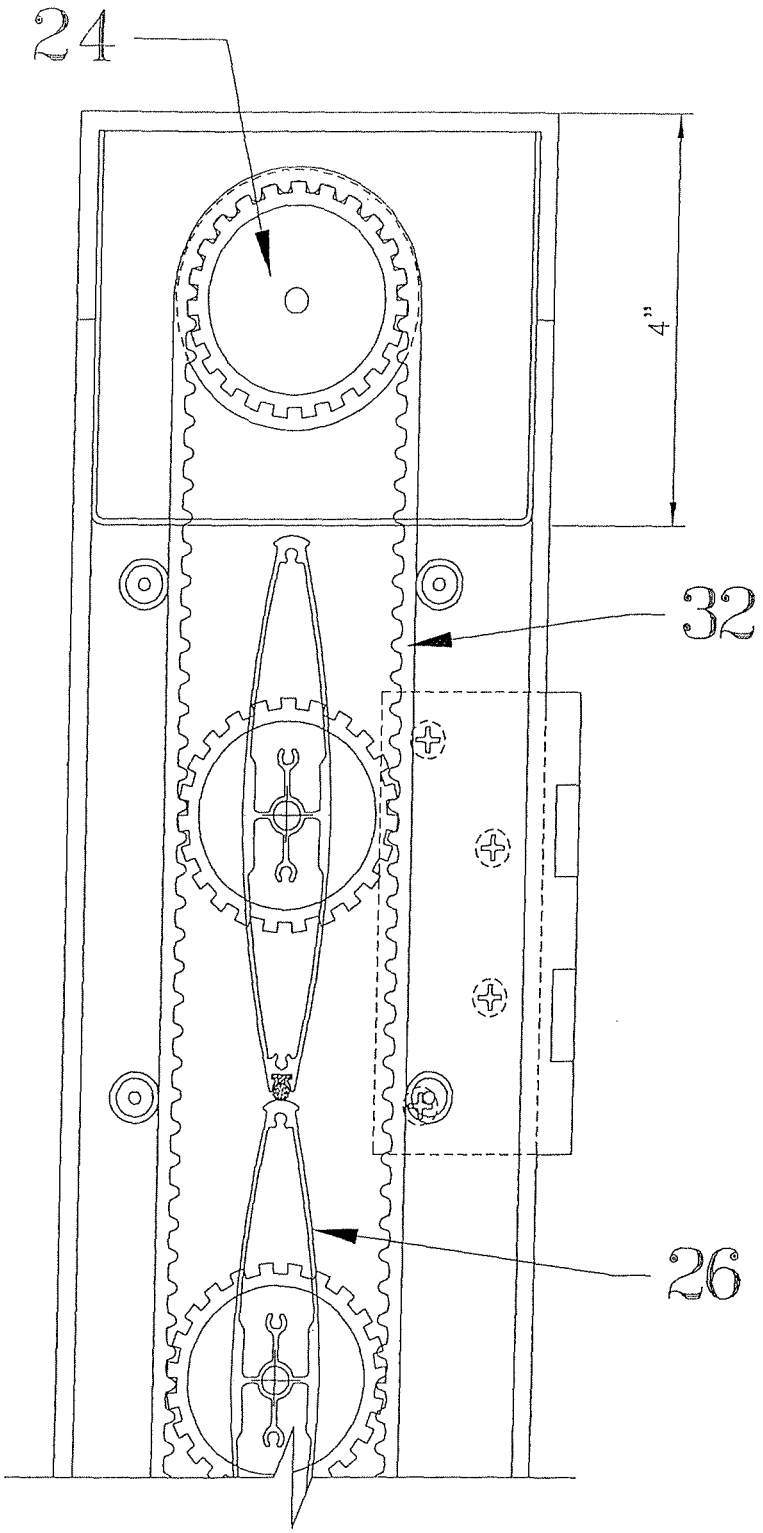
FIG. 7 shows a vertical section through an array of gears and a toothed belt the slave gears of which each are connected to and drive a louver blade.
Figure 8:
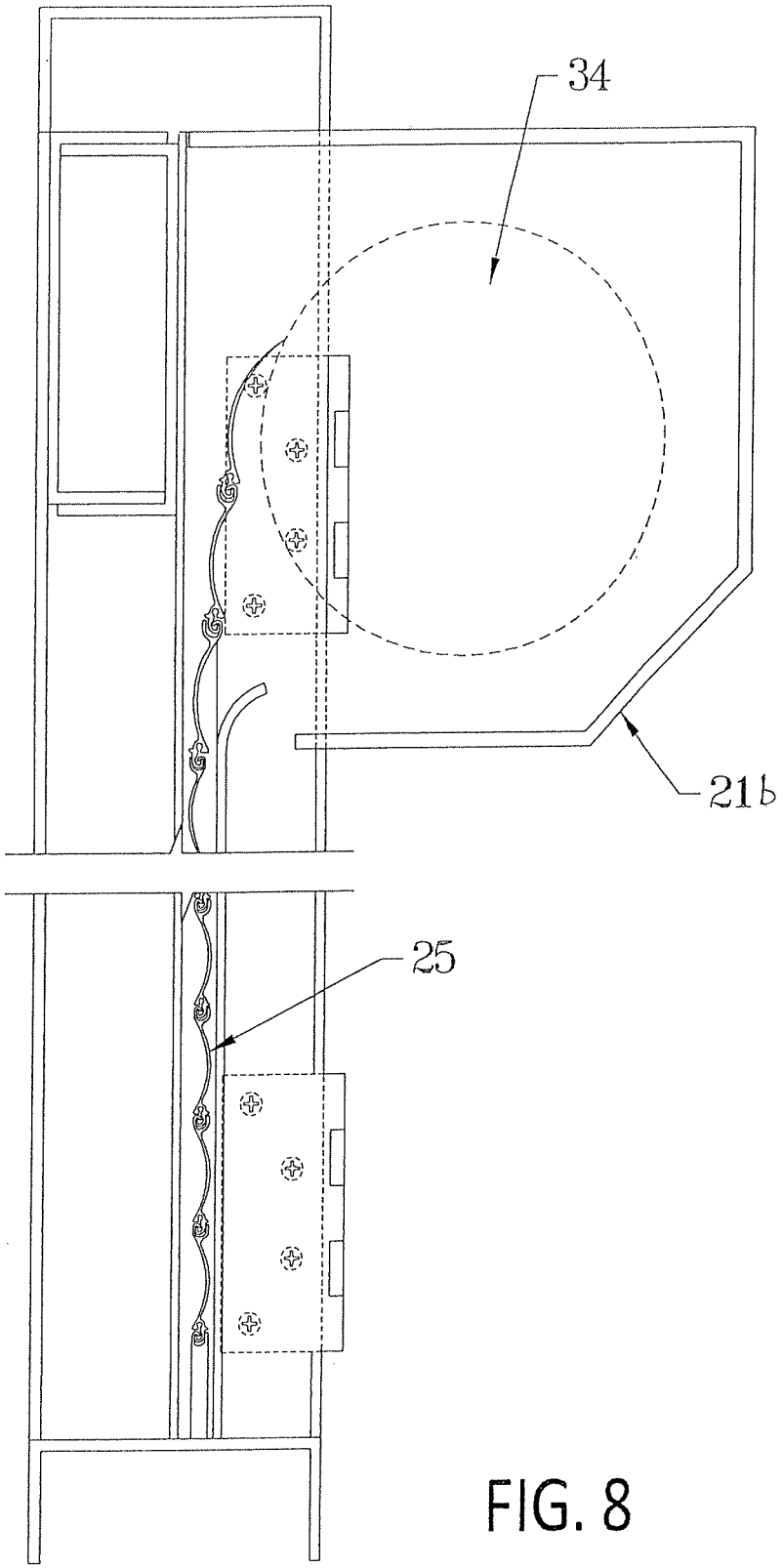
FIG. 8 shows a section through the vertical plane of an alternate embodiment using roll down shutters in lieu of louvers.

Referencing now FIGS. 7 and 8, shown is a section through the vertical plane of the sprocket assembly 24 and showing one method for driving multiple louver blades 26 using a toothed belt 32. In this instance, the sprocket assembly 24 is simply a number of sprockets which are driven by a worm gear assembly 23. FIG. 8 shows a section through the vertical plane of an embodiment with roll down shutters 25 in lieu of louvers, so here "drum 34" is a rotating drum that will extend or retract roller shutters 25. The rotating drum 34 is driven by a mechanism such as worm gear assembly 23 and is contained within a top housing 21*b* (see also FIG. 1).

The system offers aesthetic value, for example, to an architect. If used in an array, it presents a façade which is different from more common facades and, further, which can be dynamic to the extent that the appearance of the building may change on any given day, depending on the extent to which various louvers are closed or rotated into a non-closed position or, in another embodiment, roller shutters are positioned at differing levels. Even more dramatic is a case where the louver blades 26 are painted a different color on each side. In that case, the color of the side of the building changes in each localized area, depending on which way the louvers are oriented.

In yet another embodiment, electric lighting fixtures 35 may be positioned between the module(s) and the building structure 5, typically supported by vertical mullion 2. See FIG. 3. The lighting has the advantage of providing light penetrating the underlying glass 11 which relates the lighting to the penetration of natural lighting from the atmosphere, an aesthetically pleasing feature. The location of the lighting, when viewed from the exterior of the building, will cause the entire building to glow in various amounts in various places, depending on how the louver blade arrays 8 are set.

Figure 9:
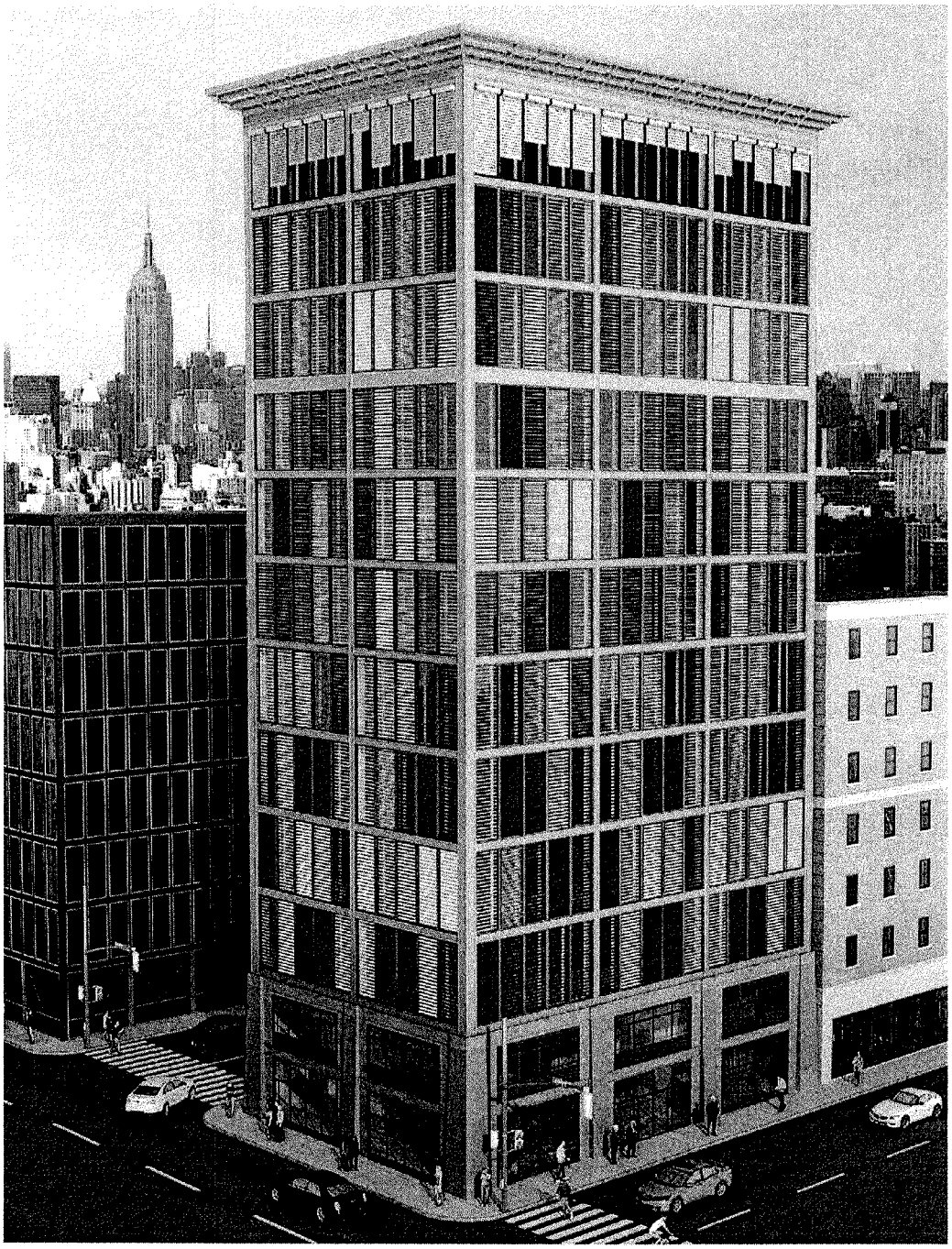
FIG. 9 is a rendering in perspective illustrating how the modules, as described herein, may appear as an array covering an entire building.

FIG. 9 is a rendering illustrating how the modules, as described herein, may appear as an array covering an entire building, thus providing partial shading, as desired, by module, plus a thermal overcoat and an aesthetically desirable appearance. As illustrated in FIG. 9, the top row of modules are roller shades, as described above, whereas the remainder of the building is clad with louvered modules also as described above.

We claim:

1. A building envelope, comprising:

a vertical support mullion on one side of a building structure, said vertical support mullion having a wall end, a projecting end, and a stop, said projecting end having a support inner edge distal from said wall end, said projecting end extending perpendicularly from said wall end and said stop extending linearly and perpendicularly from said projecting end between said wall end and said support inner edge in an opposite direction as said wall end;

a hinge including two plates, wherein one of said plates is attached to said projecting end;

a module attached to the other of said plates of said hinge, wherein said module is adapted to rotate away from said vertical support mullion;

a drive means including a gear system housed within said module and operable by a drive shaft connected through said building structure;

a cladding element connected to and operable by said drive means;

a coupling assembly engaging said drive shaft between said module and said vertical support mullion, wherein said coupling assembly disengages from said drive shaft when said module is rotated away from said vertical support mullion; and wherein said cladding element can rotate about a horizontal axis, and wherein said module holding said cladding element can rotate about a vertical axis and move away from said vertical support mullion to expose or cover an underlying glass surface.

2. The building envelope of claim 1, wherein said drive shaft has an outer shaft end and an inner shaft end, said outer shaft end connected to the coupling assembly, said coupling assembly including a coupling, said coupling having defined therein a coupling groove.

3. The building envelope of claim 2, further comprising a crank attached to said inner shaft end.

4. The building envelope of claim 2, further comprising a motor engaging said inner shaft end for rotating said drive shaft.

5. The building envelope of claim 2, further comprising a gear shaft within said module, said gear shaft shaped to fit within said coupling groove.

6. The building envelope of claim 5, further comprising a gear system engaged to and operated by said gear shaft, said gear system operating said cladding element.

7. The building envelope of claim 1, wherein said cladding element is a roll-down shutter.

8. The building envelope of claim 1, wherein said cladding element is a louver blade.

9. The building envelope of claim 1, wherein an outer-facing surface of said cladding element is coated with a heat-reflective coating material.

10. The building envelope of claim 1, further comprising an electric lighting fixture positioned between said module and said building structure.

11. The building envelope of claim 1, further comprising a cushion on said stop.

12. The building envelope of claim 1, wherein each said cladding element includes an elastomeric seal on one edge thereof.

13. The building envelope of claim 1, wherein said cladding element is insulated.

14. A building envelope, comprising:

a vertical support mullion on one side of a building structure;

a module attached to said vertical support mullion;

a gear shaft within said module;

a coupling assembly engaging said gear shaft between said module and said building structure, wherein said coupling assembly includes a spring for biasing said coupling assembly, and wherein said coupling assembly includes a coupling, said coupling having a sloped surface and having defined therein a coupling groove, said coupling groove defined along an entire diameter of said coupling to thereby bisect said coupling and receive said gear shaft;

a drive shaft engaged to said coupling assembly through said building structure;

a worm gear assembly engaged to said gear shaft;

a sprocket assembly having a blade shaft, said sprocket assembly operable by said worm gear assembly;

a cladding element connected to said blade shaft, wherein said cladding element moves to at least partially expose or cover an underlying glass surface; wherein said coupling assembly disengages from said drive shaft when said module is rotated away from said vertical support mullion.

15. The building envelope of claim 14, further comprising a means for maintaining said cladding element in an aligned position.

16. The building envelope of claim 14, further comprising an electric lighting fixture positioned between said module and said building structure.

* * * * *